United States Patent [19]

Moritz et al.

[11] 4,453,390

[45] Jun. 12, 1984

[54] COMBINATION LOCK MONITORING SYSTEM

[75] Inventors: Peter G. Moritz, Werribee; Simon L. Harders, Mordialloc, both of Australia

[73] Assignee: Wormald International Limited, Crows Nest, Australia

[21] Appl. No.: 337,238

[22] Filed: Jan. 6, 1982

[30] Foreign Application Priority Data

Jan. 14, 1981 [AU] Australia ..... PE7229

[51] Int. Cl.[3] ..... E05B 39/04

[52] U.S. Cl. ..... 70/434; 70/432; 116/8; 340/542

[58] Field of Search ..... 70/432, 434; 116/7, 116/8; 340/542, 543, 686; 250/231 SE, 237 G

[56] References Cited

U.S. PATENT DOCUMENTS

| | | | |
|---|---|---|---|
| 2,788,519 | 4/1957 | Caldwell | 340/686 X |
| 2,923,928 | 2/1960 | McLaughlin | 340/686 X |
| 3,093,994 | 6/1963 | Richard | 70/434 |
| 3,225,576 | 12/1965 | Richard | 70/434 |
| 3,227,888 | 1/1966 | Sheperd et al. | 340/686 X |
| 3,392,558 | 7/1968 | Hedin et al. | 70/434 |
| 4,152,589 | 5/1979 | Mitchell | 250/237 G X |

FOREIGN PATENT DOCUMENTS

| | | | |
|---|---|---|---|
| 1496481 | 12/1977 | United Kingdom | 340/542 |

*Primary Examiner*—Thomas J. Holko
*Assistant Examiner*—Thomas J. Dubnicka
*Attorney, Agent, or Firm*—Ladas & Parry

[57] ABSTRACT

A combination lock monitoring system for recognizing and indicating electronically the condition of operation of the lock, the recognition being achieved by photo sensitive means responding to the light reflecting quality of areas on the lock bolt mechanism, the lock drop arm and a combination wheel of the combination lock, the electronic circuit responding through a binary code to the condition of the photo sensitive means, and the indication including a visual display.

7 Claims, 2 Drawing Figures

COMBINATION LOCK MONITORING SYSTEM

This invention relates to automatic systems for monitoring the conditions of combination locks.

The following facilities are required to be included in any such monitoring system:

(1) A visual indication, such as by means of an amber LED on the dial ring, when the combination lock is in its unlocked condition.

(2) A visual indication, such as by means of a green LED on the dial ring, and additionally the signalling to a remote point, of a "set" indication when all the following conditions exist.

(i) The safe or strongroom door is closed.

(ii) The boltwork is thrown.

(iii) The combination lock has been correctly scrambled.

(3) An alarm condition, relayed to a remote point, when the lock is operated under duress.

Contemporary systems achieve the foregoing facilities by way of micro switches actuated by the combination wheels of the lock. This type of action is unsatisfactory because of:

(a) Extreme difficulty in fitting.

(b) Malfunction of micro-switches due to dust.

(c) Critical positioning of switches required.

(d) Due to the mechanical action of the micro-switch associated with the first wheel of the lock, it is possible to detect that action and identify that wheel's number in the combination, thus effectively downgrading the securing of the lock.

It is the main object of the present invention to provide a monitoring system for combination locks which will provide the above facilities while alleviating the shortcomings of contemporary systems.

In accordance with the invention there is provided a monitoring system for a combination lock which includes a first apertured, rotatable combination wheel, a withdrawable lock bolt mechanism, and a lock drop arm enterable within an aperture in said wheel to permit withdrawal of said bolt mechanism, said monitoring system comprising two optical sensors each incorporating an LED and a light sensing detector fixed with respect to the combination lock and focused on respective regions of the combination lock corresponding to a face of the rotatable combination wheel and a location occupied by a part of the lock bolt mechanism when withdrawn or otherwise by part of the lock drop arm when entered within the aperture of said wheel, said face of the combination wheel having both light reflecting and non-reflecting areas and said parts of the lock bolt mechanism and said lock drop arm each having an area one of which areas is light reflecting and the other is non-reflecting, and electronic means responding to the combined response state of said optical sensors to provide an indication of the operated condition of the combination lock.

Figure 1:
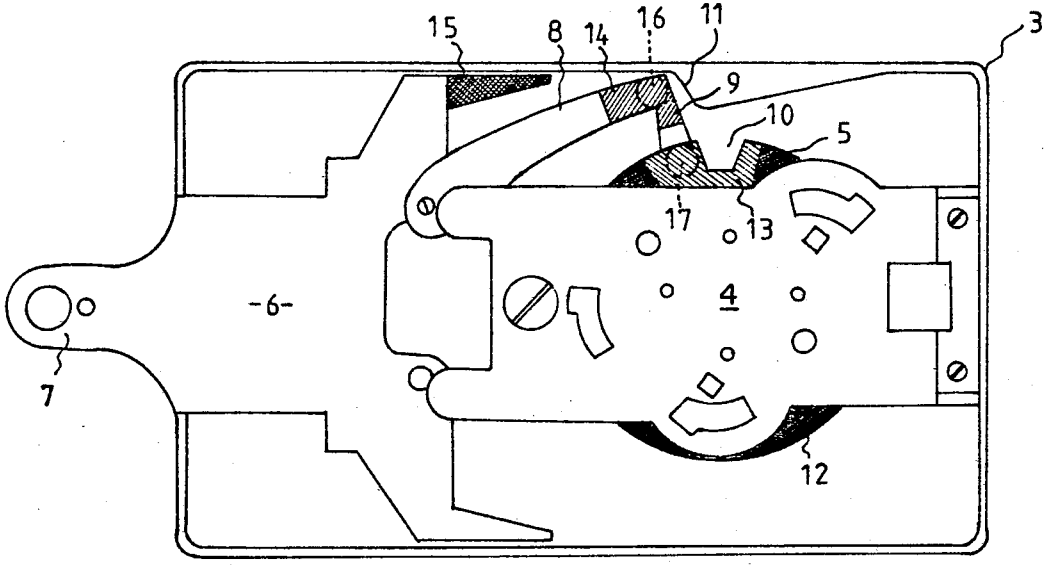
Figure 2:
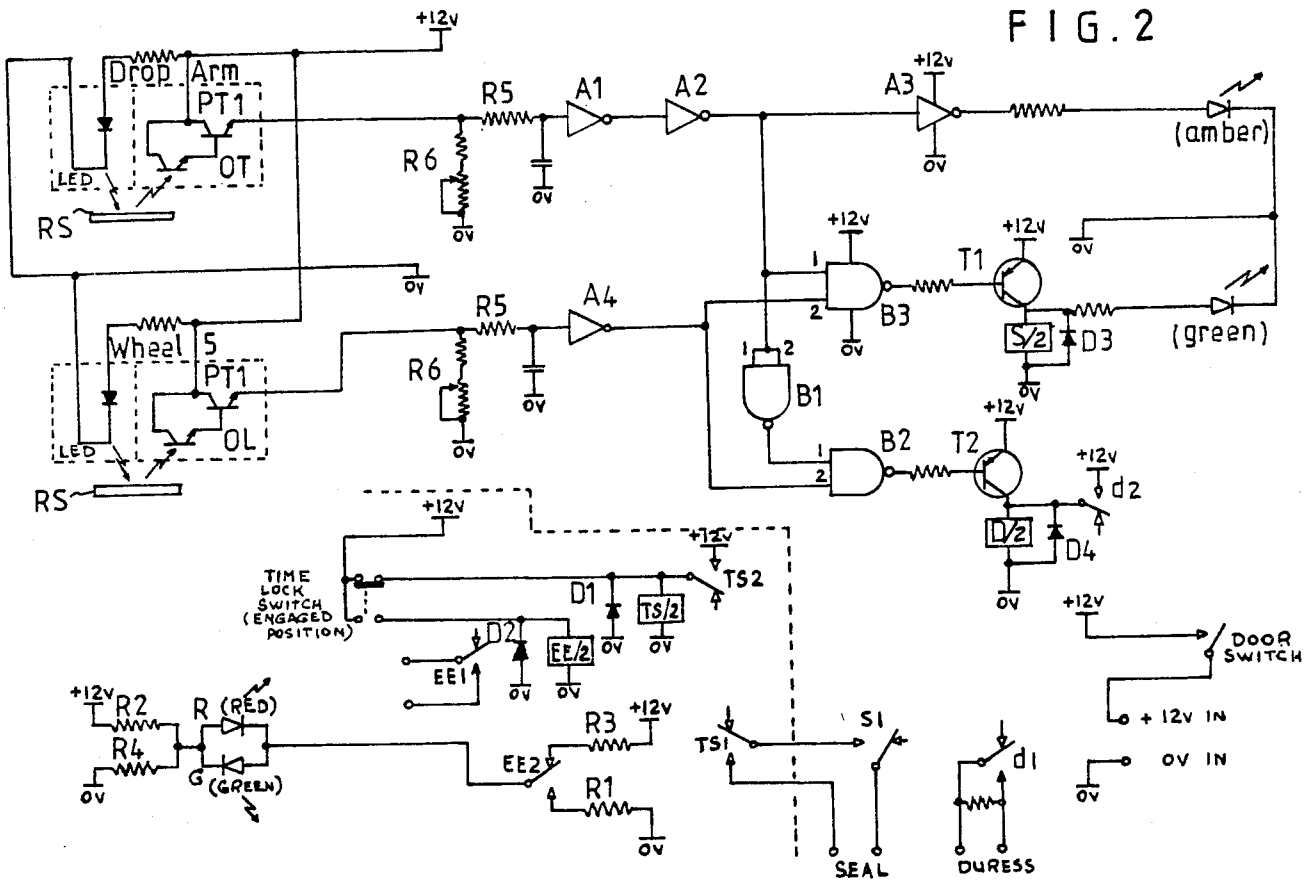

The invention will now be described in more detail with reference to the accompanying drawings, in which:

FIG. 1 is a diagrammatic internal view of a combination lock adapted for monitoring by the system of the present invention; and FIG. 2 is a schematic diagram of the monitoring system.

With reference to FIG. 1, the combination lock consists of a casing 3 and fixed therein a frame 4 rotatably supporting a plurality of axially aligned combination wheels such as a first wheel 5. A lock bolt mechanism 6 is slidable within the casing 3 between an extending position (as shown in FIG. 1) where its apertured bolt 7 is exposed to secure closed the door to which the lock is attached, and a withdrawn position within the casing 3. A lock drop arm 8 is pivoted by one end to the lock bolt mechanism 6 and has a detent 9 overlying the combination wheels, such as wheel 5, which are arranged in a row. Notches 10 as in wheel 5, or other forms of apertures, are provided in the periphery of the combination wheels so that when the correct combination has been dialed upon the lock all of the notches 10 in the wheels 5 will be aligned beneath the detent 9. In a scrambled condition of the wheels 5 the lock bolt mechanism 6 is prevented from withdrawal by engagement of the lock drop arm 8 with the abutment 11 internally provided in the casing 3. However, when the notches 10 are aligned beneath detent 9 the lock drop arm 8 falls below the abutment 11 to permit withdrawal of the lock bolt mechanism 6 into the casing 3.

By this invention, almost all of the side face of the first combination wheel 5 is provided with a light non-reflecting finish 12, shown in the drawing as cross-hatched, and an area of the face adjacent the notch 10 is provided with a light reflecting finish 13 shown in the drawing in single hatched form. As can also be seen, the outer end portion 14 of the lock drop arm is also provided with a light reflecting finish, while an extension 15 of the lock bolt mechanism 6 is provided with a light non-reflecting finish. Optical sensors (not shown in FIG. 1) are fixed in position with relation to the casing 3 and focused on regions 16 and 17. Although a different binary, or other code may be employed, for the purpose of illustration it will be assumed that the output of each optical sensor provides a "1" when focused upon a light reflecting finish, and a "0" when focused upon a light non-reflecting finish. The following table shows the monitored condition of the lock relative to the collated outputs of the two optical sensors.

| Optical sensor (16) | Optical sensor (17) | Monitored condition |
|---|---|---|
| 1 | 0 | Green lamp-door locked and combination scrambled |
| 0 | 1 | Amber lamp-door unlocked |
| 0 | 0 | Remote alarm-duress condition |

In an appreciation of the above table it will be necessary to note that a "1" output from sensor 17 occurs when the notch 10 of the wheel 5 is in an approximately correct position according to the access combination, while a "1" output from sensor 16 occurs when the combination lock is in a locked condition such as shown in FIG. 1. In an unlocked condition it will be noted that the non-reflecting characteristic of the extension 15 of the lock bolt mechanism 6 will replace the lock drop arm 8 beneath the sensor 16 to produce a "0" output. The condition of the lock shown in FIG. 1 is locked but without the first wheel 5 adequately scrambled. When the latter has been effected a "0" output is derived from the sensor 17.

Before proceeding to a description of the electronic control circuit, shown in FIG. 2, which responds to the outputs from the photo sensors 16 and 17, it should be noted that besides the optical sensors the following switching facilities are included. A microswitch (shown only in FIG. 2) is fitted to the body of the safe or strong room, to which the combination lock is supplied, in a position so that closure of the door operates the switch. Closure of this switch applies +12 Volts to the electronic circuitry. In those instances where a time lock is provided (as in FIG. 2), a further microswitch (also shown in Fig. 2) is fitted to the time lock mechanism so that when the mechanism is engaged a relay is energized, the contacts of the relay completing circuits to a master alarm panel to provide local and remote indications. The system of the invention is composed principally of three major components, viz. a 12 Volt DC power supply derived from a master alarm panel, a combination lock including optical sensors and two indicating lamps, and an electronic control panel.

Referring now to FIG. 2, sensing of relative positions of the mechanical components of the lock mechanism, discussed above with reference to FIG. 1, is provided by the use of two optical sensors OT and OL. These sensors are combined LED's and photo-sensitive devices and are arranged so that when light emitted from the LED strikes a relecting surface RS, the phototransistor conducts and a positive voltage appears at the output. The Ov line from the power supply is connected at all times to the Ov rail on the PC board and the Ov line to the sensors. When the safe or vault door is closed, operation of the microswitch applies +12v to the positive rail on the PC board and to the sensors OT and OL. With the door open and the microswitch in the unoperated condition, no positive voltage is available and it is impossible to obtain any indication whatsoever.

When the time lock microswitch is operated to its "time lock engaged" position (as shown in FIG. 2), a circuit is completed from +12v via the microswitch and the coil of relay TS/2 to Ov. Relay TS/2 operates, contact TS1 preparing the circuit for the remote set or seal indication. Contact TS2 completes the circuit from +12v to the relay and latches the relay independent of the position of the microswitch. TS/2 relay can only be released by opening the door and removing the +12v supply from the PC board. A reverse connected diode D1 is connected in parallel with TS/ relay coil to prevent voltage spikes on operation and release of the relay.

When the time lock microswitch is operated to the "time lock expired" position, a circuit is completed from +12v via the microswitch and the coil of relay EE/2 to Ov. At the same time, the operating circuit of relay TS/2 is broken, making relay TS/2 completely dependent on its latching contact TS2. Relay EE/2 operates, contact EE1 completing the circuit for a remote expiry indication. Contact EE2 changes condition and completes a circuit from Ov, via resistor R1, contact EE2 operated to LED R, resistor R2 to +12v. The red LED R illuminates, indicating that the time lock has expired.

When relay EE/2 is in the normal de-energized state during the time lock engaged period, the indicator circuit is made from +12v via resistor R3, contact EE2 released, LED G, resistor R4 to Ov. The green LED G illuminates, indicating that the time lock is engaged.

A reverse connected diode D2 is connected in parallel with EE relay coil to prevent voltage spikes on operation and release of the relay.

Integrated circuit A is a quad Schmidt trigger used as a series of inverters. Integrated circuit B is a quad dual input NAND gate used to gate the various outputs from the inverters. T1 and T2 are PNP transistors used to drive relays S/2 and D/2 respectively. When a reflective surface appears in front of sensor OT, the phototransistor PT1 conducts and its output goes high. A1 output is then low, A2 output high, A3 output low. Conversely when a non-reflective surface appears, the phototransistor ceases conducting and its output becomes low. Now A1 output is high, A2 output is low and A3 ouput high. Inputs to A1 and A4 are provided with a series resistor R5 and potentiometer R6 to enable the triggering level to be adjusted.

Consider now the operation of the circuit when the combination lock has been operated, the bolt mechanism locked and the combination scrambled. The scrambling of the combination by turning the dial five times has placed the four wheels in positions such that the slots in the wheels are no longer in alignment and in addition has permitted the first wheel 5 to turn. The segment of the wheel 5 painted white together with the section 5 of the drop arm 8 is now in a position where the light emitted from the LED section of sensor OT reflects the light into the photosensitive section composed of the phototransistor PT1 causing the output to become high. At the same time a non-reflective surface is presented to sensor OL and its output is low. The output of A3 becomes low, preventing the amber LED from illuminating. The output of A2 becomes high thus sending the input 1 of B3 high. The output of A4 becomes high, thus sending input 2 of B3 high. The output of B3 becomes low, enabling transistor T1 to conduct, relay S/2 operates, and the green LED illuniates. Relay S/2 operating causes contacts S1 to complete the circuit for the remote set or seal indication. S2 contact is unused. The reverse diode D3 in parallel with the coil of relay S/2 prevents voltage spikes on operation or release of the relay S/2.

The high from the output of A2 also sends both inputs of B1 high and the output becomes low thus sending input 1 of B2 low. The high from the output of A4 also sends input 2 of B2 high. The output of B2 thus remains high, inhibiting transistor T2 and holding relay D/2 inoperative.

Consider now the operation of the circuit when the combination lock has been operated and the bolt mechanism withdrawn. The positions of the relective and non reflective surfaces within the lock are now so are arranged that sensor OT is non-conducting and sensor OL is conducting. Sensor OT output is therefore low and sensor OL high. The output of A3 becomes high and the amber LED illuminates. The output of A2 becomes low, thus sending input 1 of B3 low. The output of A4 becomes low, sending input 2 of B3 low. The output of B3 becomes high, inhibiting transistor T1 so that the green LED is extinguished and relay S/2 releases. Contact S1 breaks the circuit to the remote set or seal indicator. The low from the output of A2 also sends both inputs of B1 low and the output becomes high sending input 1 of B2 high. The low from the output of A4 also sends input 2 of B2 low and the output remains high, inhibiting transistor T2 and holding relay D/2 inoperative.

Consider now the operation of the circuit when the combination is operated under duress. The positions of the reflective and non-reflective surfaces within the lock are now so arranged after the combination has been dialed and the bolt mechanism withdrawn that both sensors OT and OL outputs are low. The output of A3 becomes high and the amber LED illuminates. The output of A2 becomes low thus sending input 1 of B3 low. The output of A4 becomes high, sending input 2 of B3 high. The output of B3 becomes high inhibiting transistor T1 and causing the relay S/2 to release. Contact S1 breaks the circuit to the remote set or seal indicator. The low from the output of A2 also sends both inputs of B1 low and the output becomes high, sending input 1 of B2 high. The high from the output of A4 also sends input 2 of B2 high so that the output of B2 becomes low, enabling transistor T2 and causing relay D/2 to operate. Contact S1 closes and completes a circuit to a remote duress alarm. Contact D2 completes a direct circuit from +12v via the relay coil to Ov making its operation independent of the state of transistor T2, and latching relay D/2. A reverse diode D4 connected in parallel with relay D/2 coil prevents voltage spikes during operation and release. The relay D/2, having latched, can be released only by opening the door and removing the +12v supply line.

A preferred embodiment has been described in the foregoing passages and it should be understood that other forms, modifications and refinements are possible within the scope of this invention.

What we claim is:

1. A monitoring system for a combination lock which includes a first apertured, rotatable combination wheel, a withdrawable lock bolt mechanism, and a lock drop arm enterable within the aperture in said wheel to permit withdrawal of said bolt mechanism, said monitoring system comprising two optical sensors each incorporating an LED and a light sensing detector fixed with respect to the combination lock and focused on respective regions of the combination lock corresponding to a face of the rotatable combination wheel and a location occupied by a part of the lock bolt mechanism when withdrawn or otherwise by part of the lock drop arm when not entered within the aperture of said wheel, said face of the combination wheel having both light reflecting and non-reflecting areas and said parts of the lock bolt mechanism and said lock drop arm each having an area one of which areas is light reflecting and the other is non-reflecting, and electronic means responding to the combined response state of said optical sensors to provide an indication of the operated condition of the combination lock.

2. A monitoring system as claimed in claim 1, wherein said part of the lock drop arm is light reflecting and said part of the lock bolt mechanism is light non-reflecting, and said face of the combination wheel is light non-reflecting except for an area adjacent said aperture therein.

3. A monitoring system as claimed in claim 2, wherein the combined response state of said optical sensors is arranged in a binary code with each element of said code comprising a "1" or "0" state corresponding to the response state of the respective one of said optical sensors.

4. A monitoring system as claimed in claim 2, wherein the "1" state of each of said code elements corresponds to response by the optical sensor to a light reflecting area, whereby the coded conditions of said combination lock are as follows: Optical Sensor (16), Optical Sensor (17) Monitered condition

| | | |
|---|---|---|
| 1 | 0 | door locked and combination scrambled |
| 0 | 1 | door unlocked |
| 0 | 0 | duress condition |

5. A monitoring system as claimed in claim 4, including an alarm circuit to indicate operation of the combination lock under duress, or forced conditions when the coded condition "0—0" occurs, said alarm circuit comprising a relay controlled by a transistor responsive to a NAND gate.

6. A security device such as a safe or vault, provided with an access door, a combination lock on said door, and a monitoring system for said combination lock, said combination lock comprising a rotatable combination wheel, a withdrawable lock bolt mechanism, and a lock drop arm enterable into an aperture in said wheel to permit withdrawal of said lock bolt mechanism; and said monitoring system comprising a microswitch responsive to the open and closed conditions of said door, two optical sensors each of which includes an LED and a light sensing detector fixed with respect to the combination lock and focused on respective regions of the combination lock corresponding to a face of the rotatable combination wheel and a location occupied by a part of the lock bolt mechanism when withdrawn or otherwise by part of the lock drop arm when not entered within the aperture of said wheel, said face of the combination wheel having both light reflecting and non-reflecting areas and said parts of the lock bolt mechanism and said lock drop arm each having an area one of which areas is light reflecting and the other is non-reflecting, and electronic means responding to the combined response state of said optical sensors to provide an indication of the operated condition of the combination lock, and receiving power via contacts of said microswitch so that when said door is open said electronic means is deprived of power.

7. A security device as claimed in claim 6, wherein said indication of the operated condition of the combination lock is obtained through a binary code of signals and said electronic means includes logic circuits responding to said signals.

* * * * *